US007372215B2

(12) United States Patent
Sekine et al.

(10) Patent No.: US 7,372,215 B2
(45) Date of Patent: May 13, 2008

(54) LAMP BALLAST FOR CIRCUIT DRIVING MULTIPLE PARALLEL LAMPS

(75) Inventors: Masashi Sekine, Torrance, CA (US); Thomas J Ribarich, Laguna Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 120 days.

(21) Appl. No.: 11/063,427

(22) Filed: Feb. 22, 2005

(65) Prior Publication Data

US 2005/0184685 A1 Aug. 25, 2005

Related U.S. Application Data

(60) Provisional application No. 60/546,368, filed on Feb. 19, 2004.

(51) Int. Cl.
*G05F 1/00* (2006.01)

(52) U.S. Cl. ..... 315/291; 315/307

(58) Field of Classification Search ..... 315/209 R, 315/224–226, 291, 307

See application file for complete search history.

(56) References Cited

U.S. PATENT DOCUMENTS

| | | | | |
|---|---|---|---|---|
| 5,650,694 | A * | 7/1997 | Jayaraman et al. | 315/225 |
| 5,869,935 | A * | 2/1999 | Sodhi | 315/225 |
| 6,031,342 | A * | 2/2000 | Ribarich et al. | 315/291 |
| 6,326,740 | B1 * | 12/2001 | Chang et al. | 315/291 |
| 6,483,260 | B1 * | 11/2002 | Flory, IV | 315/325 |
| 6,628,091 | B2 * | 9/2003 | Griffin et al. | 315/291 |
| 7,154,232 | B2 * | 12/2006 | Contenti et al. | 315/225 |
| 2004/0263089 | A1 * | 12/2004 | Contenti et al. | 315/225 |

* cited by examiner

*Primary Examiner*—Thuy V. Tran
*Assistant Examiner*—Jimmy T Vu

(57) ABSTRACT

A lamp ballast circuit for driving, e.g. four flourescent lamps with a ballast control IC such as the IR2167 Ballast Control IC. The circuit includes a lamp replacement detection circuit for detecting insertion of a lamp, and in response, controlling the ballast control IC to initiate automatic restart for of the control IC for proper firing of the lamps, including the newly inserted lamp.

11 Claims, 2 Drawing Sheets

LAMP BALLAST FOR CIRCUIT DRIVING MULTIPLE PARALLEL LAMPS

CROSS-REFERENCE

This application is based upon and claims priority of U.S. Provisional Application No. 60/546,368 filed Feb. 19, 2004, incorporated by reference.

BACKGROUND OF THE INVENTION

1. Field of the Invention

The present invention relates to a lamp ballast circuit for driving multiple parallel lamps, and more particularly to a ballast circuit including a circuit for detection of when a lamp is inserted.

2. Related Art

There are several ways to drive four (for example) fluorescent lamps with an electronic ballast, including series configuration, parallel configuration and combined series and parallel configuration. But driving the four lamps in parallel has the advantage of lower voltage stress on the ballast output stage components, the wiring and the fixture sockets, as compared to the others. In addition, the resonant inductors and capacitors associated with the lamps will be less sensitive to component tolerances because running lamp voltage is lower. Further, even when one or more lamps is removed, the others can continue to run. For these reasons, the parallel configuration is more popular nowadays.

An excellent fluorescent lamp driver IC is the IR2167 manufactured by the International Rectifier Corporation. The IR2167 allows setting the various parameters such as preheat time and frequency, ignition ramp characteristics, running frequency and power through external programmable components. And comprehensive protection features of the IR2167 protect the overall circuitry from failure conditions such as lamp strike failures, lamp failures, low DC BUS and thermal overload. Also, the IR2167 controls its PFC circuitry with the critical conduction mode, which provides high power factor, low THD and DC Bus regulation. Thus, the IR2167 will be a suitable example, although not the only possible example, of a chip for use with the circuits to be described herein.

SUMMARY OF THE INVENTION

A problem that may occur when a lamp is inserted into an empty socket, of a plurality of sockets driven by the same driver, is the possibility of a cold strike. The lamp is not properly heated upon the application of power. The present invention addresses this problem by providing a circuit and method for driving multiple fluorescent lamps in parallel with a single ballast control IC, including a circuit and method for detecting insertion of a lamp and controlling the ballast control IC so as to prevent cold striking.

According to one aspect, the invention relates to a method of driving multiple lamps in parallel in corresponding drive circuits with an electronic ballast, which may comprise the steps of detecting the insertion of one said lamp into its drive circuit, and in response, controlling said electronic ballast to initiate an ignition sequence for the lamp. The ignition sequence may preheat the lamp in order to avoid a cold strike. The controlling step may include the steps of shutting down all of the multiple lamps and then initiating the ignition sequence for all of the lamps. The controlling step may further include the step of supplying a shutdown signal to a control IC of the electronic ballast, thereby causing the control IC to shut down and then reignite all of the multiple lamps.

According to another aspect of the invention, a circuit for detecting and indicating the insertion of lamp into a drive circuit may comprise an input circuit for receiving an input voltage from the drive circuit, the input voltage indicating whether a lamp is present in the drive circuit; a switching element responsive to the input voltage so as to change state upon insertion of a lamp into the drive circuit. The switching element may coact with a passive component to generate an output signal to indicate insertion of the lamp. The switching element may be a transistor connected to the input circuit; said circuit may turn on the transistor in response to lamp insertion, causing a current to flow; and the current may charge a capacitor, the capacitor being connected in series with a resistor so that the current generates a voltage pulse as the output signal. The voltage pulse in turn may be adapted to control the electronic ballast.

Other features and advantages of the present invention will become apparent from the following description of an embodiment of the invention which refers to the accompanying drawings.

DESCRIPTION OF EMBODIMENTS OF THE INVENTION

Figure 2:
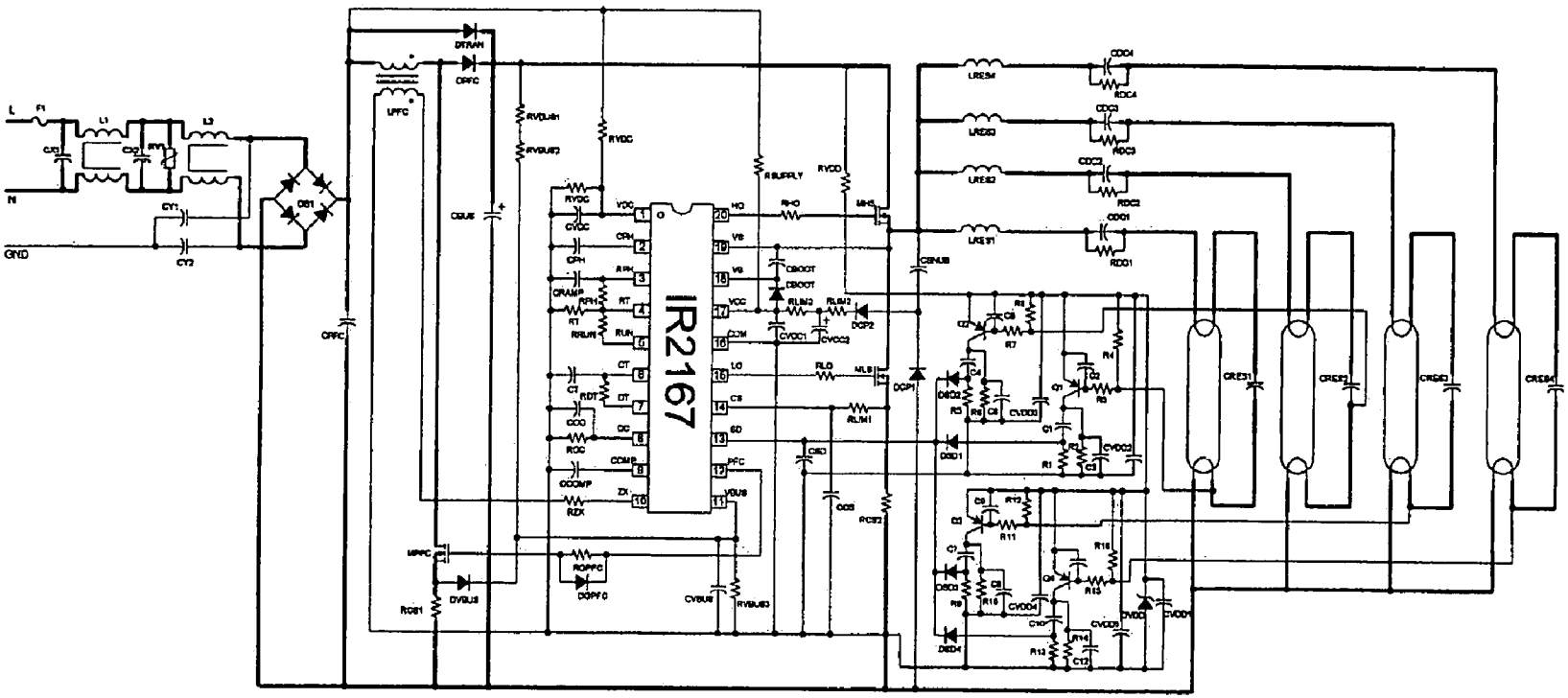
FIG. 2 is a schematic diagram showing four fluorescent lamps driven in parallel by a lamp ballast including the IR2167 control IC.

The schematic diagram in FIG. 2 shows the overall circuitry of this example. The IR2167 controls the entire ballast, except the input stage. The design is similar to that for a single lamp; and in addition, there are three other lamps and their respective resonant circuits connected in parallel. The second, third and fourth lamps are connected in parallel using the same circuitry as for the first lamp output circuit. This provides the same resonant L and C, and basic protective circuitry for all lamps due to their parallel setting.

The IR2167 ballast control IC including its ballast operating functions and protection features is described, e.g., in U.S. Provisional Patent Application Ser. No. 60/482,334 filed Jun. 24, 2003 and its corresponding non-provisional Ser. No. 10/875,474 filed Jun. 23, 2004, (Attorney Docket IR-2199). See also Ser. No. 09/981,753 filed Oct. 19, 2001, now U.S. Pat. No. 6,617,805 (IR-1807). The foregoing documents are incorporated by reference.

Figure 1:
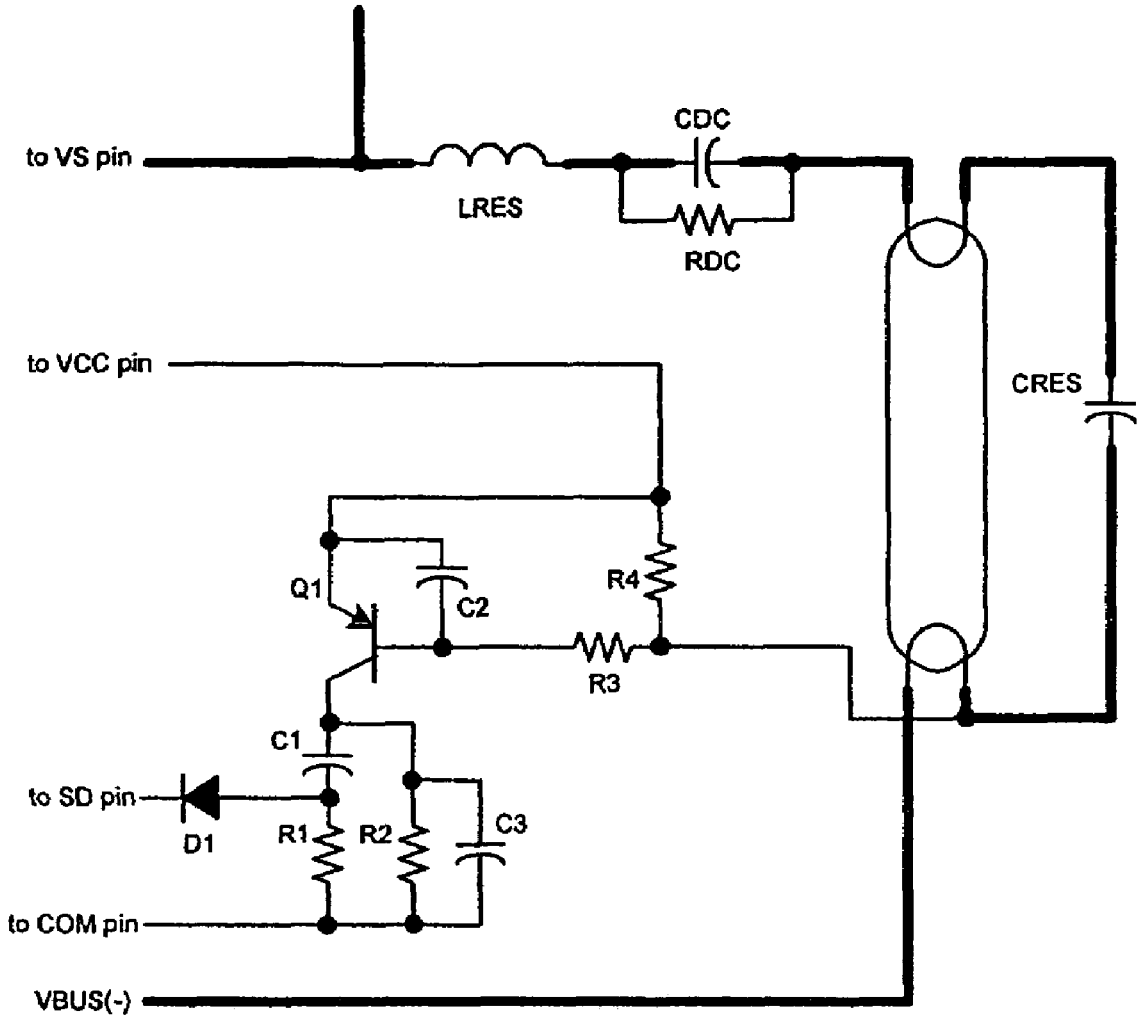
FIG. 1 is a schematic diagram of a lamp replacement detection circuit.

One of the important functions provided by this design is lamp replacement detection for controlling the control IC to provide proper filament heating at the lamp. FIG. 1 shows the circuitry for the lamp replacement detection. This circuit causes the IC to re-initiate the preheat sequence to avoid a cold strike, when a lamp is connected while other lamps are already being driven.

When a lamp is removed or when the lamp is initially absent from the group of four lamps, the base of the PNP transistor Q1, in the lamp replacement detection circuit corresponding to the missing lamp, is pulled high. This turns Q1 off, discharging the capacitor C1 through R2, but does not affect SD. Thus the voltage of the SD pin of the IR2167 remains at 2V. The other lamps will therefore keep running.

When the lamp is reinserted, Q1 is turned on and a short voltage pulse appears at the SD pin via the diode D1 due to C1 and R1. This pulse momentarily pulls the SD pin voltage above the 5.1V threshold and resets the IR2167. As the SD pin voltage then falls below 4.9V, the IR2167 is restarted in the preheat mode. This ensures proper heating of the filaments before the new lamp is re-ignited.

If all lamps are removed or if there is an initial no load condition, hard-switching will occur at the half-bridge and then the IC will enter the fault mode due to the overcurrent protection feature.

The circuit in FIG. 1 comprising R1-R4, C1-C3, D1 and Q1 monitors one lamp. Therefore another three of the same circuit are included in the overall circuit (FIG. 2) for detecting the other three lamps.

Although the present invention has been described in relation to particular embodiments thereof, many other variations and modifications and other uses will become apparent to those skilled in the art. Therefore, the present invention is not limited by the specific disclosure herein.

What is claimed is:

1. A circuit for detecting and indicating the insertion of lamp into a drive circuit, comprising:

an input circuit for receiving an input voltage from said drive circuit, said input voltage indicating whether a lamp is present in said drive circuit;

a switching element responsive to said input voltage so as to change state upon insertion of a lamp into said drive circuit;

said switching element acting together with a passive component to generate an output pulse to indicate insertion of said lamp;

input wherein said switching element is a transistor connected to said input circuit;

wherein said circuit turns on said transistor in response to lamp insertion, causing a current to flow so as to generate said output pulse; and wherein said current charges a capacitor, said capacitor being connected in series with a resistor so that said current generates a voltage pulse as said output pulse.

2. A circuit for driving a plurality of lamps in parallel, using an electronic ballast having a ballast control IC, comprising:

a plurality of parallel drive circuits driven by said electronic ballast corresponding to said plurality of lamps to be driven;

a plurality of lamp detecting circuits connected respectively to said plurality of drive circuits for detecting and indicating the insertion of a lamp into the respective one of said drive circuits;

each of said lamp detection circuits comprising:

an input circuit for receiving an input voltage from said respective drive circuit, said input voltage indicating whether a lamp is present in said drive circuit;

a switching element responsive to said input voltage so as to change state upon insertion of a lamp into said drive circuit;

said switching element acting together with a passive component to generate an output pulse to indicate insertion of said lamp;

said output pulse being operative to control said ballast control IC to initiate an ignition sequence for said newly inserted lamp.

3. The circuit of claim 2, wherein said switching element is a transistor connected to said input circuit.

4. The circuit of claim 3, wherein said circuit turns on said transistor in response to lamp insertion, causing a current to flow so as to generate said output pulse.

5. The circuit of claim 4, wherein said current charges a capacitor, said capacitor being connected in series with a resistor so that said current generates a voltage pulse as said output pulse.

6. The circuit of claim 2, wherein said ignition sequence preheats said lamp in order to avoid a cold strike of said lamp.

7. The circuit of claim 2, wherein said controlling steps includes the steps of shutting down all of said multiple lamps and then initiating said ignition sequence for all of said multiple lamps.

8. The circuit of claim 7, wherein said ignition sequence includes a preheating step.

9. The circuit of claim 2, wherein said controlling step includes the step of supplying said output pulse as a shutdown signal to said control IC of said electronic ballast and thereby causing said control IC to shut down and then reignite all of said multiple lamps.

10. A circuit for detecting and indicating the insertion of lamp into a drive circuit, comprising:

an input circuit for receiving an input voltage from said drive circuit, said input voltage indicating whether a lamp is present in said drive circuit;

a switching element responsive to said input voltage so as to change state upon insertion of a lamp into said drive circuit;

said switching element acting together with a passive component to generate an output pulse to indicate insertion of said lamp;

wherein said switching element has first and second main terminals and a control terminal, said first main terminal being connected to a voltage source, said second main terminal being coupled to a series connection of a capacitor and a resistor, and said control terminal being coupled to said input voltage so that a) said switching element is turned off when a lamp is absent, permitting said capacitor to discharge through said resistor, and b) said switching element is turned on by the insertion of a lamp, thereby charging said capacitor from said voltage source through said switching element and said resistor, and generating said output pulse across said resistor.

11. The circuit of claim 2, wherein said switching element has first and second main terminals and a control terminal, said first main terminal being connected to a voltage source, said second main terminal being coupled to a series connection of a capacitor and a resistor, and said control terminal being coupled to said input voltage so that a) said switching element is turned off when a lamp is absent, permitting said capacitor to discharge through said resistor, and b) said switching element is turned on by the insertion of a lamp, thereby charging said capacitor from said voltage source through said switching element and said resistor, and generating said output pulse across said resistor.

* * * * *